US005806156A

United States Patent [19]

Hashizume et al.

[11] Patent Number: 5,806,156

[45] Date of Patent: Sep. 15, 1998

[54] PRECISION REED DRAWING-IN APPARATUS AND METHOD

[75] Inventors: Kenji Hashizume; Yoshiro Sakaguchi, both of Fukui, Japan

[73] Assignee: Hashizume Kenkyusho Co., Ltd., Fukui, Japan

[21] Appl. No.: 836,584

[22] PCT Filed: Oct. 28, 1996

[86] PCT No.: PCT/JP96/03142

§ 371 Date: May 7, 1997

§ 102(e) Date: May 7, 1997

[30] Foreign Application Priority Data

Nov. 10, 1995 [JP] Japan ..... 7-292576

[51] Int. Cl.[6] ..... D03J 1/14

[52] U.S. Cl. ..... 28/204

[58] Field of Search ..... 28/204, 205–207

[56] References Cited

U.S. PATENT DOCUMENTS 4,748,568 5/1988 Tobler ..... 28/204
4,894,893 1/1990 Okuda ..... 28/204
4,974,301 12/1990 Beerli et al. ..... 28/191
5,353,487 10/1994 Choh et al. ..... 28/204

FOREIGN PATENT DOCUMENTS 61-502472 10/1986 Japan .
5-98544 4/1993 Japan .

*Primary Examiner*—Andy Falik
*Attorney, Agent, or Firm*—Ronald R. Snider

[57] ABSTRACT

A reed drawing-in apparatus provides a method whereby a warp thread can be properly and smoothly drawn in a respective gap between adjoining dents of even an extremely high-density reed without being cut off during the reed drawing-in operation. A threader apparatus which can stand longer use is also used. The work carrier sequentially stops at a respective gap between adjoining dents of the reed while it moves towards the latitudinal direction of said reed. A gap opener carried on the work carrier temporarily enlarges a target gap and a threader thrusts in the enlarged gap so as to hook a warp thread sorted out from a thread supply section. Thread is drawn into the reed which is provided with a hook part thereon.

3 Claims, 12 Drawing Sheets

PRECISION REED DRAWING-IN APPARATUS AND METHOD

BACKGROUND OF THE INVENTION

1. Technical Field

The present invention relates to a method of drawing a warp thread in a looms reed. This reed drawing-in apparatus and method allows a warp thread to be properly and smoothly drawn Into a respective gap between adjacent dents of a reed where the dents are laid with extremely high density. Threads are not cut off during the reed drawing-in operation. A threader has a greater useful life. This invention serves to streamline reed drawing-in especially for the production of high-density fabrics.

2. Prior Art

Recently, for use as a plotting scale for manufacturing electronic parts, much attention has been drawn to a plain fabric which is woven by accurately intercrossing weft and warp threads of extremely thin status with precisely equal interval between adjacent threads. However, in order to weave this type of fabric, a high-density reed must be used. The number of dents in some extreme cases reaches 400 dents/inch. The dents are finely and densely disposed. With the prior reed drawing-in apparatus, it was impossible to draw a warp thread into such a high-density reed as mentioned above. Thus, warp threading into such a high-density reed depended on manual labor by an experienced and skillful worker.

An apparatus has been proposed in Japanese Patent Application Laid-Open No- 61-502472 wherein a gap between adjacent dents is probed by projecting light on the reed surface so as to analyze light which has got through an interval between adjacent reed-dents and a warp thread is mechanically drawn into said gap. However, with such a prior apparatus as mentioned above, it can probe said gap well, but the problem of smoothly drawing an extremely thin warp thread into said gap without doing damage on said warp thread remains unsolved so that it is still far from industrial applicability.

On the other hand, the present applicant has proposed a high-precision reed drawing-in apparatus in Japanese Patent Publication No.8-16301 which comprises a search light source irradiating search light onto a reed, a CCD camera picturing the reed surface irradiated with the search light, a microcomputer for calculating the distance to a target gap between adjacent dents on the basis of a picture signal output from said CCD camera and for outputting a numerical movement command signal in proportion to the calculated distance, and a threader having a hook part which is formed thinner than the gap between adjacent dents of the reed, wherein the hook part is thrust into the gap so as to hook a warp thread and draw it into said gap, and a work carrier for carrying said search light source, CCD camera, microcomputer and threader which sequentially moves from one gap to another on the reed in accordance with said numerical movement command signal so as to draw a warp thread into a target gap with the hook part of the threader. With this apparatus, because of the precisely associated movement between the accurately moving work carrier and the thin hook part of the threader in reed drawing-in operation, it has become possible to properly draw a warp thread even into a high-density reed with 300 dents/inch.

However, even with the high-precision reed drawing-in apparatus as mentioned above, as the density of dents becomes higher, such as 400 dents/inch, the hook part of the threader must be thinner and thinner. Therefore, the tip end of the hook part trembles under the influence of vibration and so on. This causes drawing-in errors of the warp thread or breakup of the hook part so that the operation needs to be frequently suspended and a number of broken hook parts must be replaced.

DISCLOSURE OF THE INVENTION

The above-mentioned problems encountered in the reed drawing-in apparatus described in Japanese Patent Publication No.8-16301 and proposed by the present applicant are solved by this invention. The present invention provides a reed drawing-in method whereby a warp thread can be properly and smoothly drawn into a respective gap between adjacent dents of even an extremely high-density reed without being cut off during the reed drawing-in operation. The operation is rarely suspended and a high-precision apparatus is used in this method.

The method adopted in the present invention is characterized in that a warp thread, held in a thread supply section arranged opposite to the reed of a loom, is sequentially drawn into a respective gap by means of the association between a "Gap Opening Operation" where the dents disposed on both sides of the respective gap are temporarily and sequentially enlarged by intermittently stopping a work carrier provided with a gap opener and a threader while the work carrier is moving in the latitudinal direction of the reed, and a "Threader Inserting Operation" where the threader is thrust into the enlarged gap.

The apparatus adopted in the present invention is characterized in that the associated movement between a gap opener which temporarily spreads apart the dents disposed on both sides of a target gap just located where a work carrier has stopped, and a threader which is thrust into the gap enlarged by the gap opener and hooks a warp thread from the thread supply section and draws said warp thread into the enlarged gap, is incorporated into the work carrier which sequentially stops in response to the respective gap while moving in the latitudinal direction of the reed.

Now, further comments on the constitution of the present invention are given as follows. First, a work carrier movement is adopted in the present invention for sequentially spreading apart the dents disposed on both sides of a respective gap. This work carrier is under the numerical control of an input movement command signal and sequentially and precisely stops in response to the respective gap while moving in the latitudinal direction of the reed.

The precise shift of the work carrier across the reed is realized by means of a light beam source, a CCD camera and a microcomputer carried on the carrier. Namely, when the light beam projects a localised search beam towards the surface of the reed where a number of dents are disposed, a CCD camera converts the quantity of light received, which varies according to whether there is a dent at a searched area, into photoelectricity and outputs said light quantity as a picture signal to a microcomputer. Then, a microcomputer calculates the distance to a target gap existing between adjacent dents on the basis of said picture signal output from said CCD camera and then outputs a numerical movement command signal so as to numerically control a shift motor installed in the work carrier and shift said work carrier to a computed position.

Then, the gap opener and the threader are also carried on the work carrier of the present invention. The gap opener is a mechanical part which is thrust into a respective target gap between adjacent dents of the reed just opposite where the work carrier has stopped under the numerical control of the input movement command signal as mentioned above and temporarily enlarges the gap. As a gap opener, a sharp-pointed or lanceolate pin by means of a back-and-forth driving mechanism (e.g. a servomotor and cam mechanism) can be adopted. In this case, the tip end of the pin aims at a gap corresponding to the position where the work carrier has stopped. Turning to the threader, it is thrust into the enlarged gap and hooks a warp thread from the thread supply section arranged opposite the reed with a hook part provided at its tip end so as to draw said warp thread into the reed. The threader moves in association with and subsequently to the gap opener also by means of a back-and-forth driving mechanism such as a servomotor. Therefore, the hook part is longitudinally arranged on the threader along a gap formed by the reed-dents. However, there is no problem even if the threader moves successively following the motion of the gap opener when the work carrier has stopped. In this connection, it is preferable that the instant the work carrier has stopped at a fixed position under the numerical control of the input movement command signal, the computer receiving the information that the work carrier has stopped successively sends a thrust signal and a reed drawing-in signal to the driving mechanism of the gap opener and the threader respectively. The reed drawing-in apparatus embodied in the present invention is based on the relationship between the "Gap Opening Operation" where the gap opener temporarily enlarges a respective gap by separating reed-dents disposed on both sides of the gap and the "Threader Inserting Operation" where the threader is thrust into the enlarged gap. Therefore, even when the reed drawing-in operation is performed on a high-density reed having an extremely fine gap between adjacent reed-dents, there is no case where the warp thread is damaged or cut off due to excessive stress such as friction during operation.

The reed drawing-in apparatus embodied in the present invention can automatically perform a fast reed drawing-in operation even on a high-density reed with more than 400 dents/inch. Therefore, it is an improvement over the prior art disclosed in Japanese Patent Publication No.8-16301. This invention streamlined preparatory work in a factory where a high-density fabric is manufactured. Its industrial applicability is extremely high.

DETAILED DESCRIPTION OF THE PREFERRED EMBODIMENT

The whole movement of a reed drawing-in apparatus (D) embodied in the present invention and shown in the accompanying drawings is achieved substantially as follows.

Figure 1:
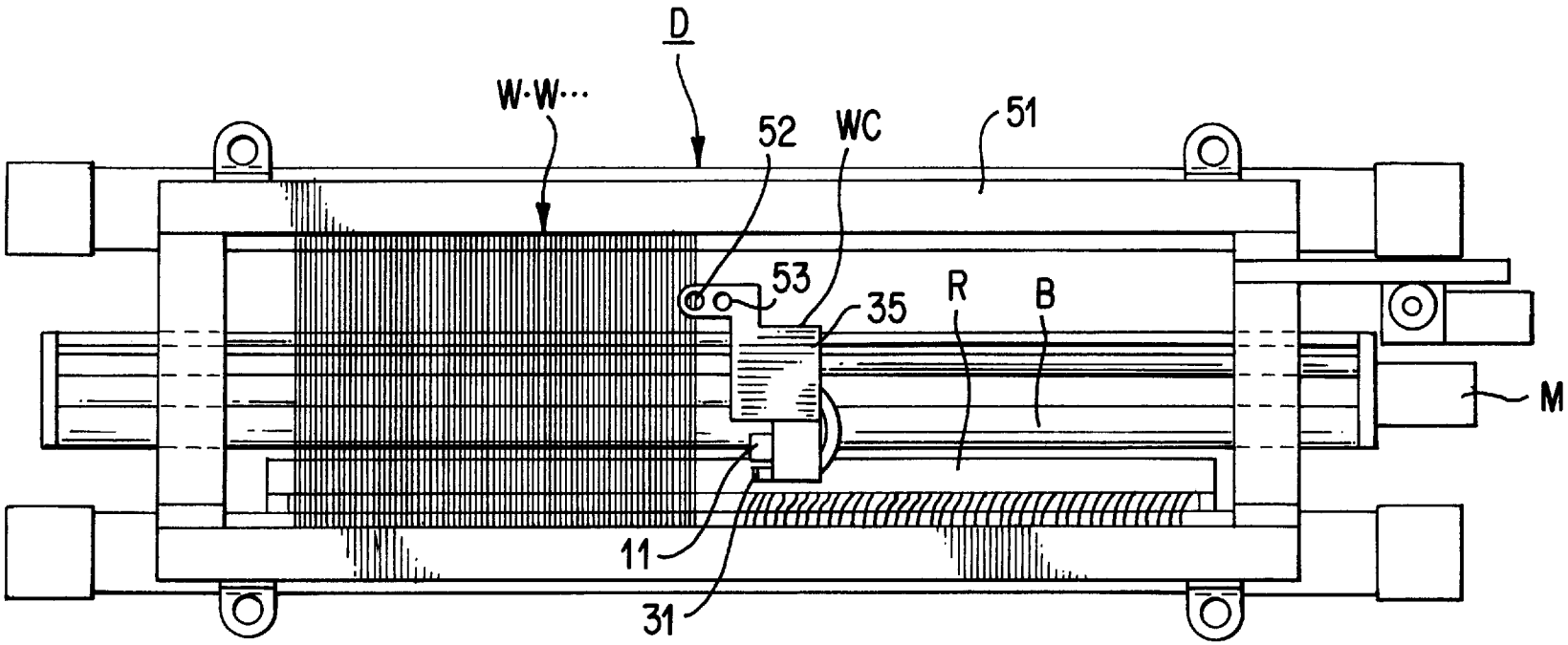
FIG. 1 is a schematic plan view of the reed drawing-in apparatus embodied in the present invention.
Figure 2:
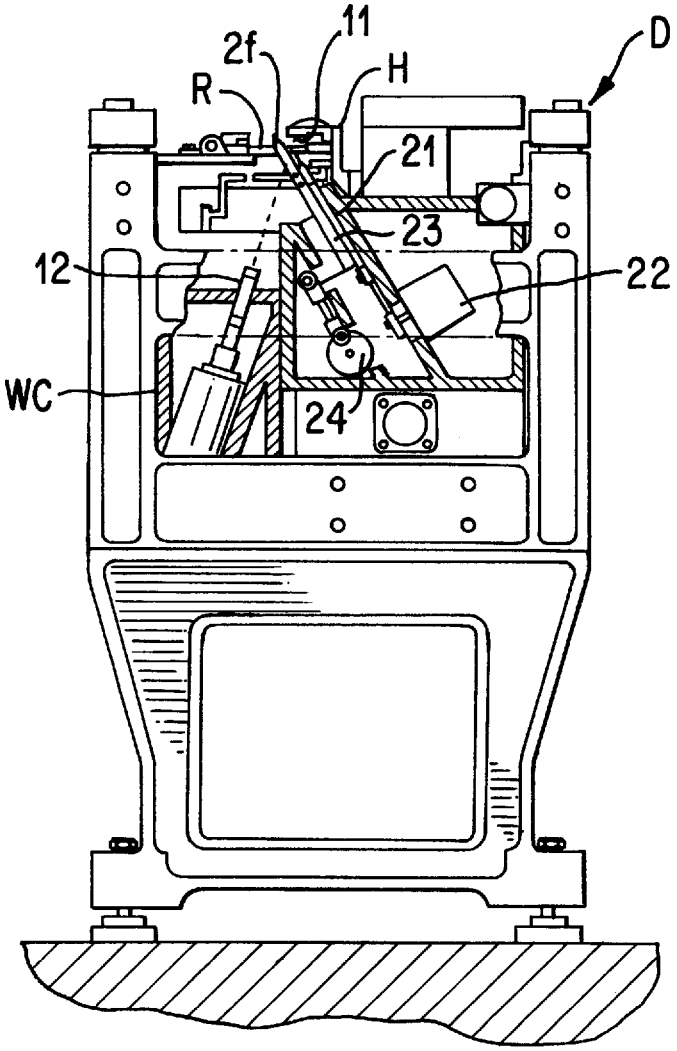
FIG. 2 is a schematic sectional view of the work carrier carrying a CCD camera, a beam source, a gap opener and a threader.
Figure 3:
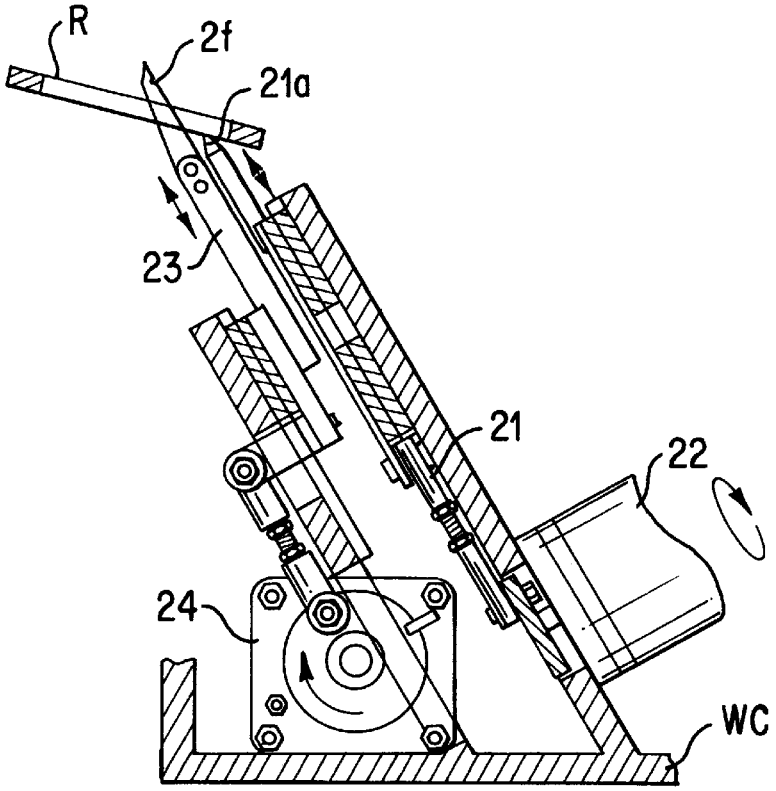
FIG. 3 is a fragmentary enlarged sectional view of the work carrier showing the motions of a gap opener and a threader embodied in the present invention.
Figure 4:
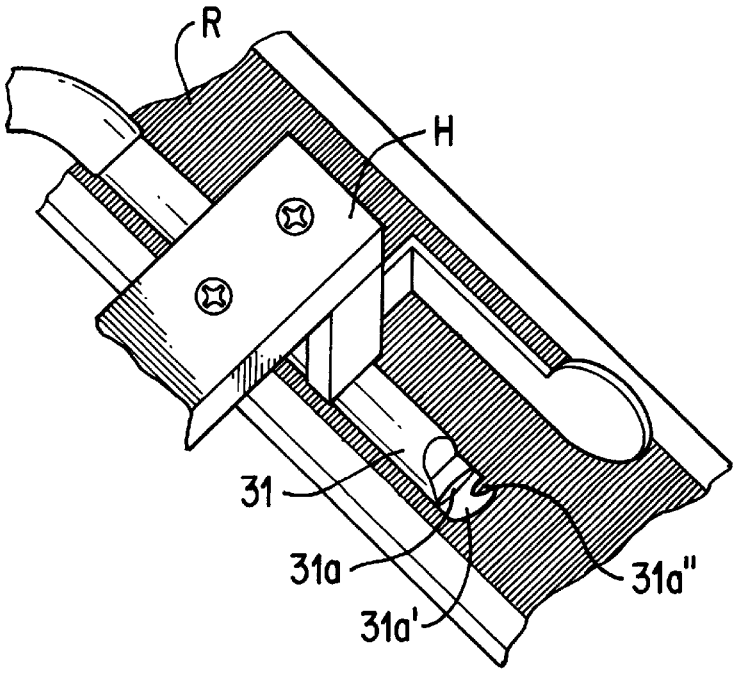
FIG. 4 is an enlarged perspective view of a warp thread suction tensioner excluding the beam source of FIG. 1.
Figure 5:
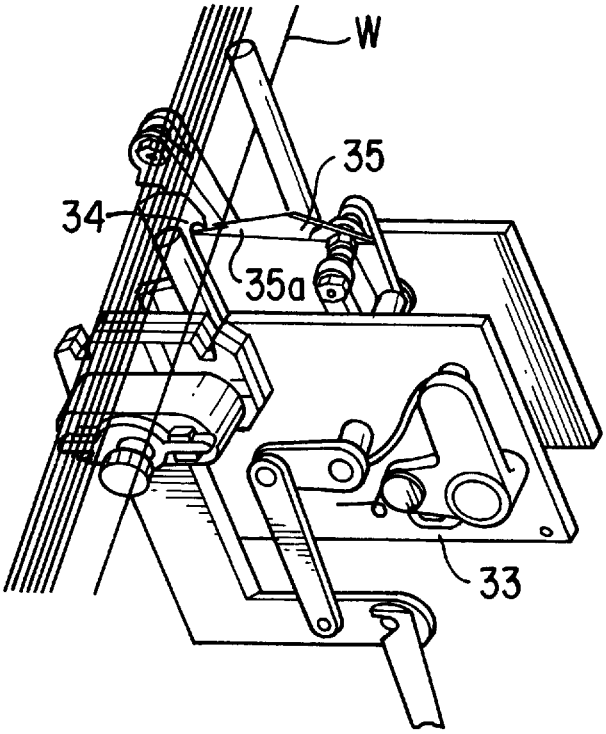
FIG. 5 is a fragmentary enlarged view of a warp thread selector of the work carrier showing said selector hooking a warp thread sorted out from a warp thread holder and drawing said thread toward the delivery position.
Figure 6:
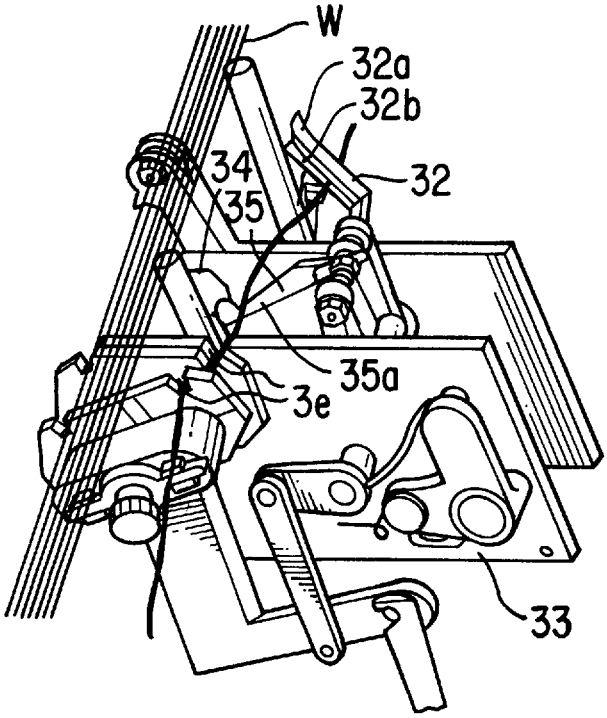
FIG. 6 is a fragmentary enlarged view of a warp thread cutter and a warp thread manipulator of the work carrier showing said cutter cutting off a warp thread and the manipulator picking up the cut-off thread.
Figure 17:
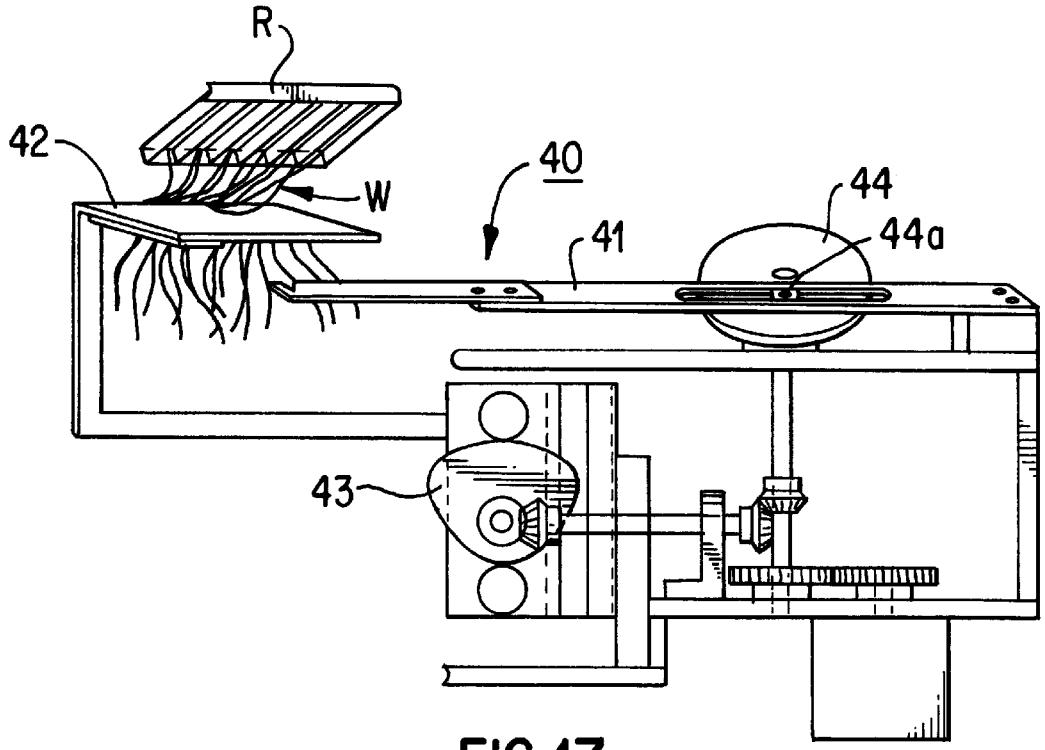
FIG. 17 is a partially perspective view showing the warp thread arrangement mechanism adopted in the reed drawing-in apparatus embodied in the present invention.
Figure 18:
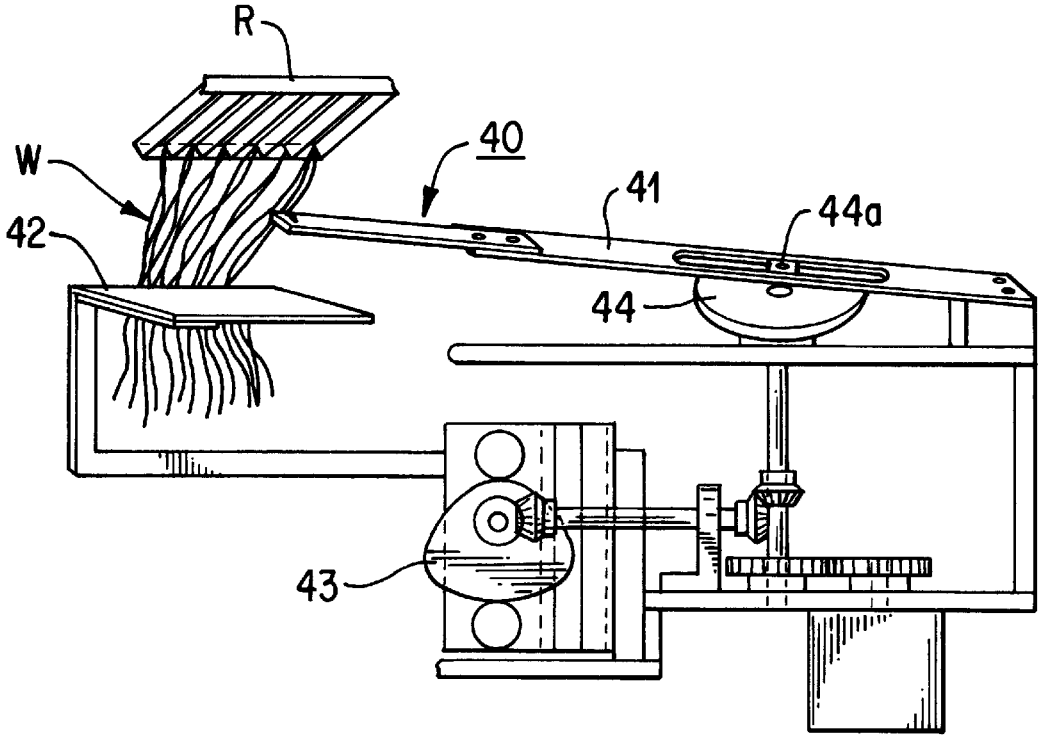
FIG. 18 is a partially perspective view showing the state where the bracket of the warp thread arrangement mechanism has reached a lowermost position.

First, as shown in FIG. 1, a high-density reed (400 dents/inch) (R) is horizontally placed on the apparatus (D). With this apparatus (D), a reversably rotatable ball screw (B) driven by a shift control motor (servomotor) (M) is horizontally suspended below said reed (R). Said ball screw (B) engages with a work carrier (WC) so as to make said carrier shift just by a required distance. In reference to the accompanying drawings, a beam source (11), a CCD camera (12), a gap opener (21) and its back-and-forth driving mechanism or servomotor (22) as well as a threader (23) and its back-and-forth driving mechanism or servomotor (24) for causing thrust and draw-in movements respectively are shown in FIG. 2. A warp thread suction tensioner (31) is shown in FIG. 4 while a warp thread manipulator (32), a warp thread cutter (33), a warp thread transport hook (34) and a warp thread selector (35) respectively are shown in FIGS. 5 and 6. A warp thread arrangement mechanism (40) is shown in FIGS. 17 and 18, the above technical features being all systematically carried on the work carrier (WC) along the transfer passage of the warp thread.

Figure 7:
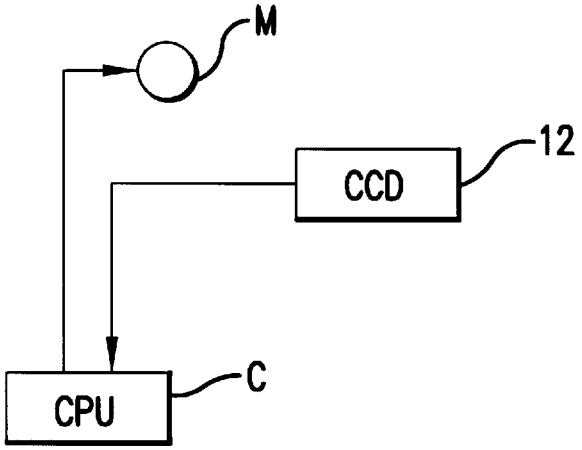
FIG. 7 is a block diagram showing the three-way control signal flow between a microcomputer, a CCD camera and a servomotor embodied in the present invention.
Figure 8:
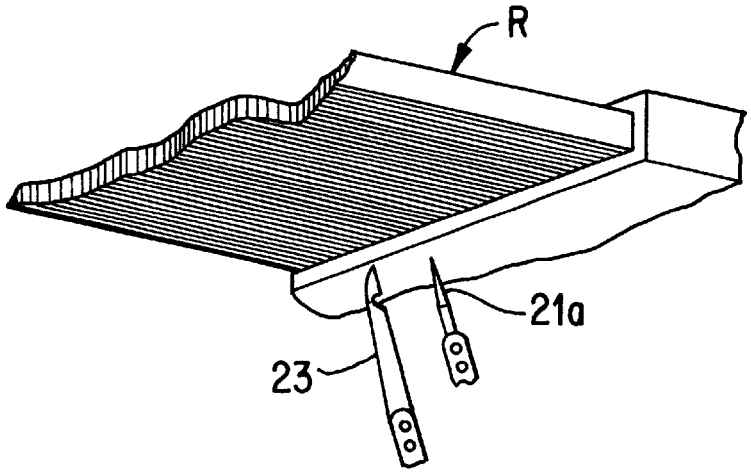
FIG. 8 is a perspective view of the gap opener and the threader embodied in the present invention seen from the underside of the reed showing the state thereof immediately before the sharp-pointed pin of the gap opener projects through the reed.
Figure 9:
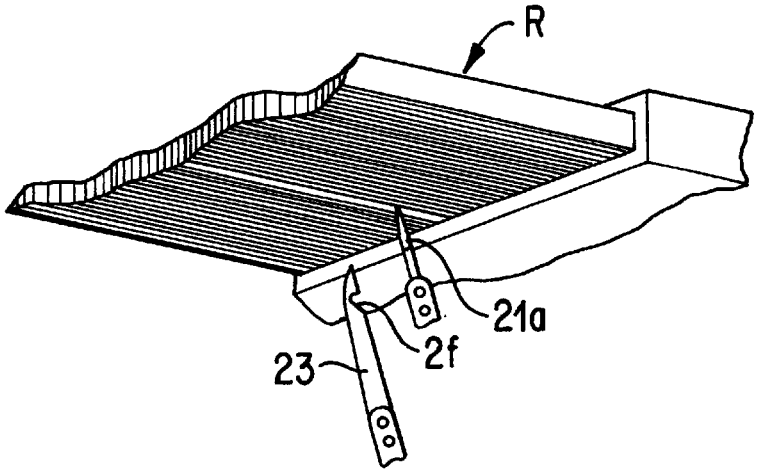
FIG. 9 is a perspective view of the gap opener and the threader embodied in the present invention seen from the underside of the reed showing the state thereof where the sharp-pointed pin of the gap opener is thrust into a target gap of the reed so as to enlarge said gap and the threader starts to move towards the enlarged gap.

Further commenting on the above-mentioned embodiment in accordance with the accompanying drawings, FIG. 2 shows that said beam source (11) and warp thread suction tensioner (31) are placed above the reed (R) which is arranged on the reed drawing-in apparatus (D), while said CCD camera (12) and threader (23) are opposedly placed below the reed (R) against the beam source (11). Said beam source (11), warp thread suction tensioner (31), CCD camera (12) and threader (23) are all arranged so that they shift together with the work carrier (WC). Accordingly, a gap between adjacent dents of the high-density reed (R) is searched by the beam source (11), and is picturized in the CCD camera (12). The picturized gap is analyzed with a microcomputer (C) installed on the work carrier (WC). Then, the analysis data is sent to the servomotor (M) as shown in FIG. 7 so that the work carrier (WC) shifts accordingly and reaches a gap between adjacent dents where the search light intensity becomes largest directly below the gap. Then, when the work carrier (WC) is stopped at said gap, said computer (C) emits a thrust signal to the servomotor (22) of the gap opener (21) so as to actuate upward projection of a sharp-pointed pin (21*a*)(a gap opener tip) through the target gap. The projection of the sharp-pointed pin (21*a*) causes the dents on both sides of the gap to separate so that the gap becomes enlarged. Then, after the enlargement of the gap, said computer (C) emits a threading signal to the servomotor (24) of the threader (23). The actuation of the threader (23),causes its hook part (2*f*) to be thrust into the gap and to project a little above the reed (R) (see FIGS. 10 and 11). Then, a warp thread (W) is led into the upper side of the reed (R) and the end portion of the thread (W) is drawn into the warp thread suction tensioner (31). This warp thread suction tensioner (31) takes in the warp thread (W) through its suction opening (31*a*) under a required air suction pressure produced by a compressor (not shown in the drawings). The warp thread (W) taken into the tensioner (31) is arranged 50 that it meets the hook part (2*f*) projecting above the reed (R). This way, when the warp thread (W) is hooked on the nook part (2*f*), the threader (23) retreats below the reed (R) by means of the servomotor (24) so that the warp thread (w) is drawn into the gap between adjacent dents of the reed (R).

Hereinafter, the concrete constitution realizing the above mentioned motions of a reed drawing-in apparatus embodied in the present invention is described in more detail.

A infrared LED (light emitting diode) of super-high luminance is adopted as the beam source (11) provided above the reed (R) arranged on the reed drawing-in apparatus (D) embodied in the present invention. This LED is rotatable upward and escapably installed on a bracket (H) hinged with the work carrier (WC). When the reed (R) is arranged on the reed drawing-in apparatus (D), the LED along with a warp thread suction tensioner (31) are spring biased upward so that they can move to a position where they do not interfere with the reed (R).

Figure 12:
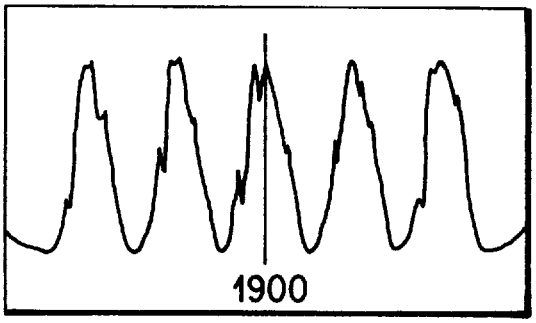
FIG. 12 is a graphical representation showing the waveform of the picture signal output from the CCD camera in accordance with the intensity of search light irradiated from the beam source before the smoothing of said picture signal.
Figure 13:
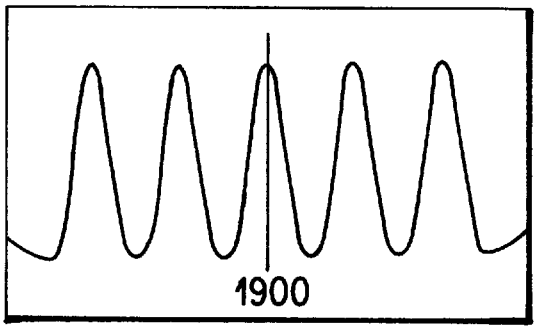
FIG. 13 is a graphical representation showing the smoothed waveform of the picture signal of FIG. 12.

Then, the CCD camera (12) is arranged below the reed (R) for the purpose of linear image processing. Charge coupled elements are arranged in one line parallel with the latitudinal direction of the reed-dents (4096 picture elements:2$\mu$/picture element). This camera (12) excites photoelectrical conversion according to the intensity of search light passing the interval between adjacent dents of the reed (R) so as to output a picture signal. The picture signal output by this camera (12) is sent to the microcomputer (C) for smoothing as shown in FIGS. 12 and 13. Then, as shown in FIG. 13. an address (1900) where the quantity or light received has peaked is read as a target gap. With the reed drawing-in apparatus embodied in the present invention, the computer (C) is preliminarily programmed so that it can read the current position of the sharp-pointed pin (21*a*) of the gap opener (21) and that of the hook part (2*f*) of the threader (28). Therefore, the computer (C) automatically emits a movement command signal to the work carrier (WC) so as to shift the sharp-pointed pin (21*a*) and the hook part immediately below an adjacent gap on the right-hand side of the previously threaded gap.

The shift of the sharp-pointed pin (21*a*) and the hook part (2*f*) to the latitudinal direction of the reed-dents (across the dents) or the shift thereof to the subsequent gap accompanies that of the work carrier (WC). The carrier (WC) shifts by rotation of the ball screw (B) provided at the lower portion of the reed drawing-in apparatus (D). Thus, rotating a servomotor (M) engaged with the ball screw (B) at a fixed rate (see a control mechanism chart in FIG. 7) enables the sharp-pointed pin (21*a*) and the hook part (2*f*) to accurately shift to the target gap.

Figure 10:
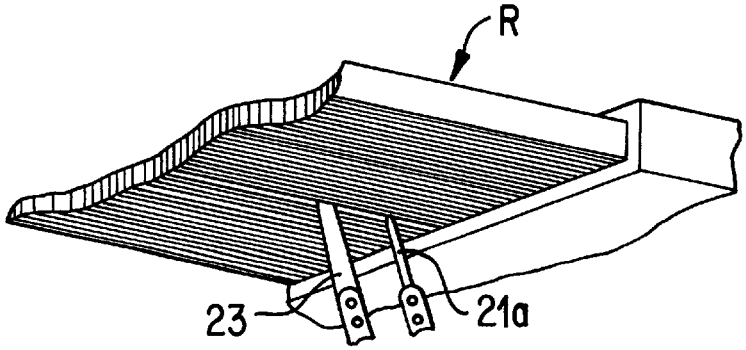
FIG. 10 is a perspective view of the gap opener and the threader embodied in the present invention seen from the underside of the reed showing the state thereof where the threader has been thrust into the target gap enlarged by the sharp-pointed pin.
Figure 11:
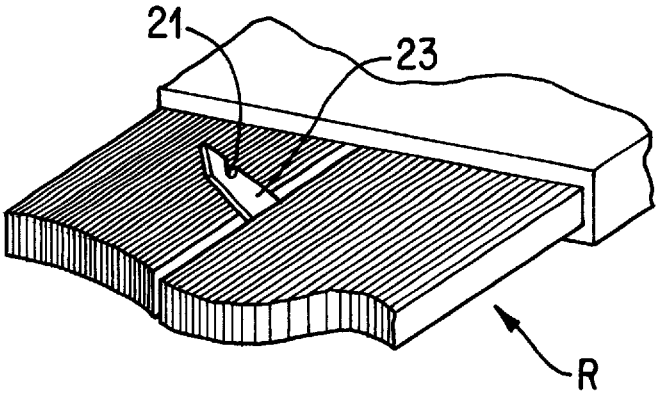
FIG. 11 is a bird's-eye view of the gap opener and the threader embodied in the present invention showing the state thereof where the hook part of the threader has extended upwardly a little above the reed.

And when the ball screw (B) in response to the movement command signal output by the computer (C) shifts the work carrier (WC) to a predetermined position or when the sharp-pointed pin (21*a*) and the hook part (2*f*) reaches a location directly below a target gap or at the intermediate position between adjacent dents, the microcomputer (C) emits a thrust signal to a servomotor (22) of the gap opener (21) so as to cause the sharp-pointed pin (a gap opener tip)(21*a*) to project above the reed (R). Because the tip of the pin (21*a*) is aimed at the target gap, it is properly thrust into an intermediate position between adjacent dents without colliding with the dents and enlarges the gap. Subsequently, said microcomputer (C) sends a threading signal to the servomotor (24) of the threader (23) so as to actuate said servomotor (24). Because the target gap is already enlarged by the sharp-pointed pin (21*a*) of the gap opener (21), after the actuation of the servomotor (24), the hook part (2*f*) smoothly projects through the gap and extends upwardly a little above the reed (R) (see FIG. 10). The sharp-pointed pin (21*a*) of the gap opener (21) provided with the reed drawing-in apparatus embodied In the present Invention has a tapered tip, the diameter of which at the foot is 2 mm and the length of which along the sloping side is 7 mm. Because the hook part (2*f*) of the threader (23) adopted in the reed drawing-in apparatus embodied in the present invention has a tip portion, the thinnest part of which is 3 $\mu$ and the thickest part of which is only 70 $\mu$ and the gap is enlarged by 2 mm with the sharp-pointed pin (21*a*) as mentioned above, and also because the hook part (2*f*) is accurately carried and positioned just below an intermediate position between adjacent dents, it can be smoothly and spaciously inserted into a reed even with 400 dents/inch as shown in FIG.10.

Then, when the hook part (2*f*) has reached its topmost position, the operation by means of each mechanism as described below for hooking a warp thread on the hook part (2*f*) begins.

First, as shown in FIG. 1, one warp thread (W) is selected from a number of the files of warp threads (W·W . . . ) orderly arranged in a warp thread holder (51) of the reed drawing-in apparatus (D) by means of the shedding motion of a pair of leasing strings that are not shown in the drawings. The warp thread selector (35) carried on the central part of the work carrier (WC) catches this selected warp thread (W) (see FIG. 5). Namely, a hook (25*a*) capable of catching only one warp thread (W) is formed on said warp thread selector (35). When the selected thread is hooked on the hook (35*a*), the hook (35*a*) swings towards the work carrier (WC) so as to draw the selected warp thread (W) near a fixed position.

Then, when the selected warp thread (W) hooked on the hook (35*a*) has shifted to the fixed position towards the work carrier (WC), the warp thread transport hook (34) provided on the selector (35) starts moving. This hook (34) is a warp thread relay mechanism whereby the selected thread (W) hooked on the selector (35) is shifted to a position where the warp thread manipulator (32) can pick up the warp thread (W), and consists of a hook member horizontally moving to and from as shown in FIGS. 5 and 6. In this way, the selected warp thread (W) transported by the warp thread transport hook (34) is delivered to the manipulator (32).

Figure 14:
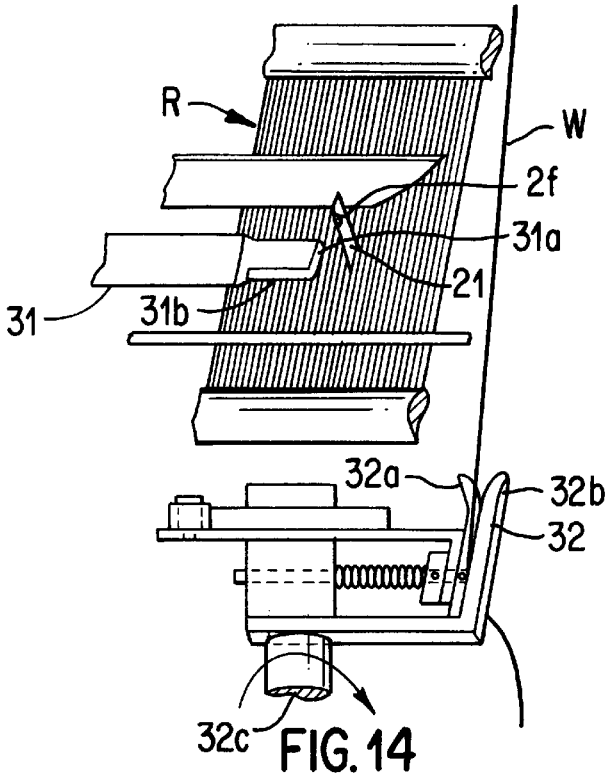
FIG. 14 is an explanatory view showing the position of a warp thread manipulator immediately before a warp thread picked up by said manipulator is delivered to the threader.

The warp thread manipulator (32) has a pair of forks (32*a*) and (32*b*) between which the warp thread (W) transported from the selector (35) is put. Then, the warp thread (N) between said forks (32*a*) and (32*b*) is cut at a fixed location with scissor blades (3*e*) and (3*e*) of the warp thread cutter (33) (see FIG. 6) and the manipulator (32) revolves around a support axis (32*c*) in the direction of the arrow indicated in FIG. 14 with the warp thread (W) between the forks (32*a*) and (32*b*) so as to carry the warp thread (W) to the delivery position (see FIG. 15).

Figure 15:
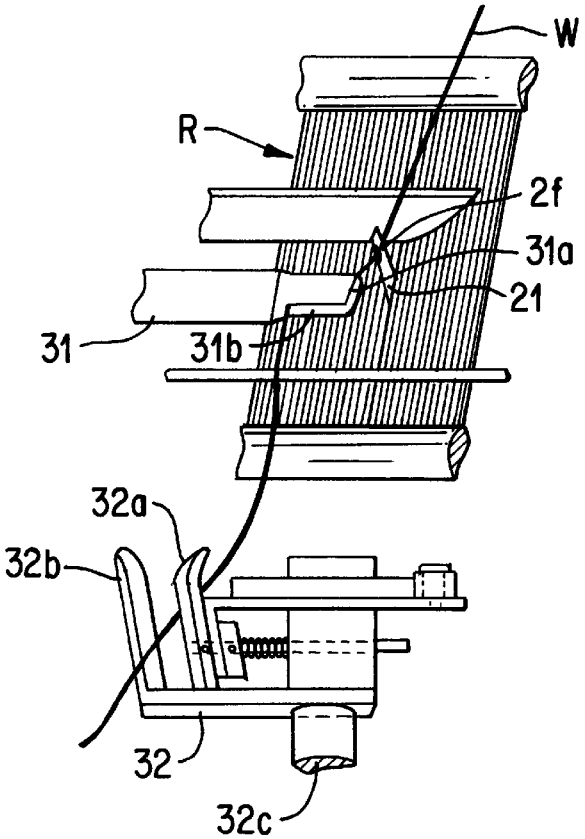
FIG. 15 is an explanatory view showing the state where the warp thread manipulator has rotated so as to carry the warp thread to the delivery position for handing it over to the threader and has released it.
Figure 16:
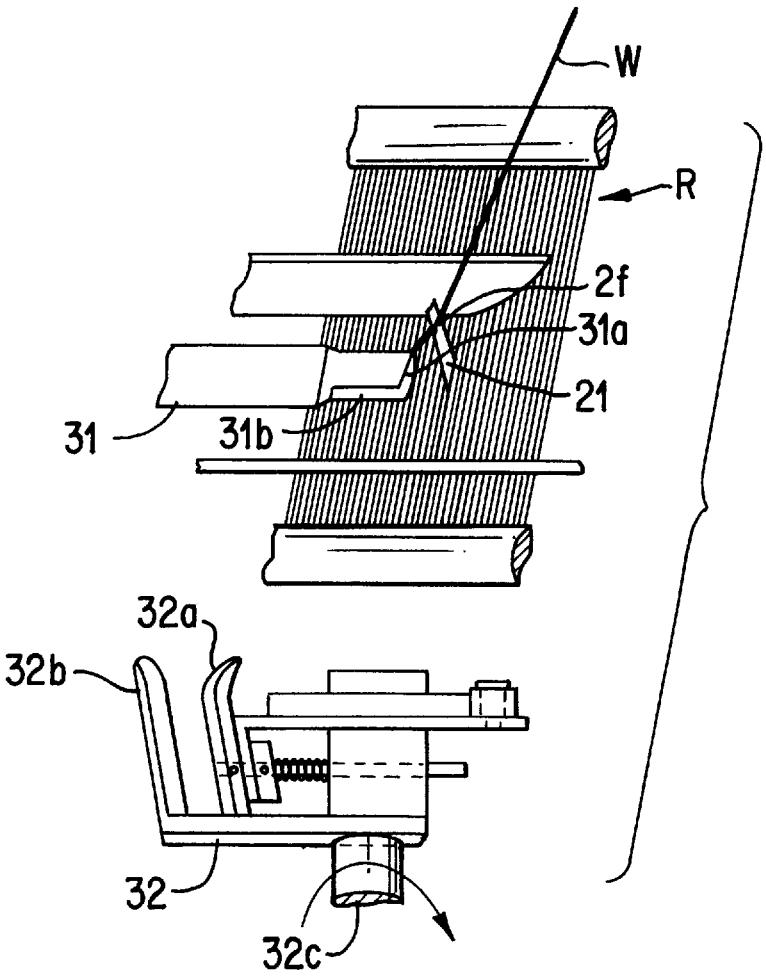
FIG. 16 is an explanatory view showing the state where the end portion of the warp thread released by the manipulator has been taken into the warp thread suction tensioner.

The warp thread (W) picked up and carried to the delivery position by the manipulator (32) with its forks (32*a*) and (32*b*), as shown in FIG. 15, is taken into the warp thread suction tensioner (31) by air suction pressure so that it can be held stable while being hooked on the hook part (2*f*) of the threader (21) After the completion of the delivery, as shown in FIG. 16, the manipulator (32) further proceeds to revolve around the support axis (32*c*) and returns to the original position Then, the end portion of the warp thread (W) hooked on the book part (2*f*) is further taken into the suction tensioner (31) so that it is held taut and straight. Because the suction opening (31*a*) of the warp thread suction tensioner (31) is formed flatly compressed in the direction of the hook part (2*f*) and also has a deep-cut slit (31*b*) formed in the direction of the forks (32*a*) and (32*b*) of the manipulator (32) which has arrived at the delivery position, even if the warp thread (w) is partly slack when the forks (32*a*) and (32*b*) have picked up and carried it, its end portion is taken in and pulled into the suction opening (31*a*) so that it is held taut and stable.

After the completion of a series of associated motions of each mechanism such as the above-mentioned warp thread selector (35), warp thread cutter (33) and warp thread transport hook (34) at the thread supply section of the reed drawing-in apparatus embodied in the present invention for the purpose of sorting out a warp thread from the files of warp threads (W·W . . . ) and supplying it to the delivery position, the threading signal output by the microcomputer (C) switches the servomotor (24) of the threader (23) to the return mode. Then, while the warp thread (W) hooked on the hook part (2*f*) is still held sufficiently taut, it slips out of the suction opening (31*a*) against air suction pressure of the warp thread suction tensioner (31), is threaded through the gap and is discharged from the hook part (2*f*) below the reed (R). Then, after the hook part (2*f*) has been retracted downwardly from the enlarged gap of the reed-dents, the servomotor (22) of the gap opener (21) is also switched to the return mode so that the sharp-pointed pin (21*a*) is retracted downwardly from the enlarged gap of the reed-dents. Upon retraction of the sharp-pointed pin (21*a*), the reed-dents elastically recover.

It should be noted that the same warp thread arrangement mechanism is adopted in the present invention as disclosed in Japanese Patent Publication No.8-16301 "A reed drawing-in apparatus of looms" proposed by the present applicant. Namely, a warp thread arrangement mechanism (40) wherein a cut-off warp thread is orderly arranged, is provided below the reed (R) so that a warp thread drawn into the reed-dents gives no trouble either to the search for a target gap or to the operation of the gap opener (21) and the threader (23) respectively.

This warp thread arrangement mechanism (40) is now explained more in detail with reference to FIGS. 17 and 18.

When a newly selected warp thread (W) is drawn into a gap of the reed-dents, a warp thread receiving bracket (42) for bundling warp threads (W) lowers according to the rotational angle of a cam (43). Then, a swing arm (41) moving horizontally to and from by means of a boss (44*a*) of a crank plate (44) rotates above the bracket (42) and brushes aside a newly drawn-in warp thread (W) from the underside of the reed (R). The bracket (42) turns to rise so that it raises a bundle of warp threads including the warp thread (W) which has been newly drawn-in and put aside, and then the swing arm (41) returns to the original position passing under the bracket (42).

Following the warp thread arrangement as mentioned above, the microcomputer (C) calculates the distance between the gap where the previously drawn-in warp thread (W) is and an adjacent or target gap to the right-hand side of said previously drawn-in gap so as to command the work carrier (WC) to shift to said target gap. In this way, sequentially drawing warp threads (W) into the reed-dents enables successive reed drawing-in operations. Another point to be emphasized regarding the embodiment of the present invention is that in order to securely hook a warp thread onto the warp thread selector (35) from the warp thread holder (51), two sensors (52) and (53) are provided on the selector (35) in the direction of the files of warp threads (W·W . . . ) as shown in FIG. 1 and are arranged so that a headmost warp thread (N) approaches the sensor (52) farther from the selector (35).

This point is explained more in detail as follows. The warp thread bolder (51) for orderly holding the files of warp threads (W·W . . . ) slides to and from against the selector (35) by means of a rack and pinion which is not shown in the drawings. The selector (35) carried on the work Carrier (NC) also slides towards the files of warp threads (W) arranged in the holder (51) during the reed drawing-in operation in response to the driving of the servomotor (M). In this case, when the density of the files of warp threads (W) is low and the headmost warp thread (W) is away from a position where it can be detected with the sensor (52) because the selector (35) slides too little, the holder(51) is slid towards the selector (35) by moving said rack and pinion one pitch at a time. On the contrary, when the density of the files of warp threads is high and the headmost warp thread (W) has reached a position where it can be detected with the sensor (53) because the selector (35) slides too much, the holder (51) including the files of warp threads is retracted by means of said rack and pinion.

As a result of repeated experiments with the reed drawing-in apparatus embodied in the present invention, it has been confirmed that said apparatus can cope with even a high-density reed (R) with 400 dents/inch without interrupting the reed drawing-in operation at all.

Figure 19:
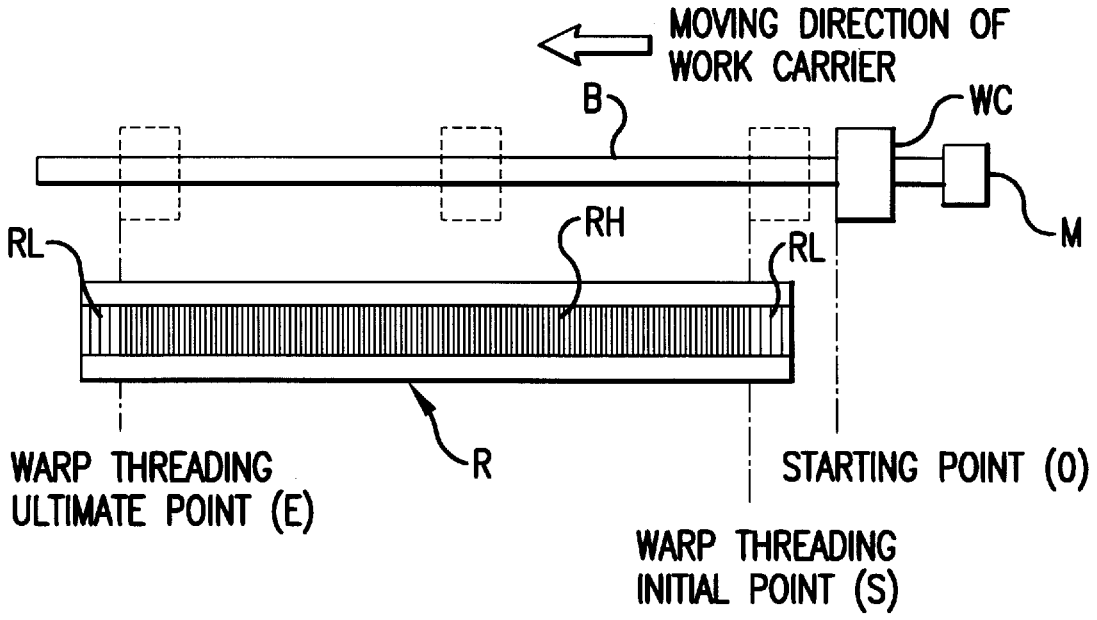
FIG. 19 is a schematic view showing the moving state of the work carrier.

Finally, a series of reed drawing-in operations is chronologically explained as follows in reference to FIGS. 19 and 20. First, the microcomputer (C) installed on the work carrier (WC) confirms by analyzing a picture signal output by the CCD camera that the work carrier (WC) is set on a predetermined starting point (O) of the bell screw (R) (step "a" of FIG. 20). Then, the work carrier (NC) is shifted from the starting point (O) to a reed drawing-in initial point (S) of the reed (R) (step "b" of FIG. 20). This initial point (S) is located at a gap in one of the two marginal regions between low-density areas (RL) formed at both sides of the reed (R) and a high-density area (RH) interposed between said low-density areas (RL) while the ultimate point (E) is located at a gap in the other marginal region.

Then, the microcomputer (C) installed on the work carrier (NC) analyzes and detects the position of the first gap and shifts the work carrier (WC) just below said gap under the numerical control and stops it (step "c" of FIG. 20). When the sharp-pointed pin (21*a*) of the gap opener (21) projects through the target gap where the work carrier (WC) has stopped, the dents disposed on both sides of the gap are separate so that said gap is enlarged (step "d" of FIG. 20). The hook part (2*f*) of the threader (23) is thrust into the enlarged gap so that it projects a little above the reed (R) (step "e" of FIG. 20). One warp thread (W) is selected from the files of warp threads (W·W . . . ) (step "f" of FIG. 20) and this selected thread is subject to air suction pressure while being hooked on the hook part (2*f*) of the threader (23) (step "g" of FIG. 20). Thereafter, the warp thread (W) is drawn into the gap of the reed-dents by retracting the threader (23) below the reed (R) (step "h" of FIG. 20). After the sharp-pointed pin (21*a*) of the gap opener (21) has been retreated below the reed (R) (step "i" of FIG. 20) and the warp thread (W) hooked on the hook part (2*f*) has been unhooked (step "j" of FIG. 20), one cycle of reed drawing-in operation is completed (step "k" of FIG. 20).

Figure 20:
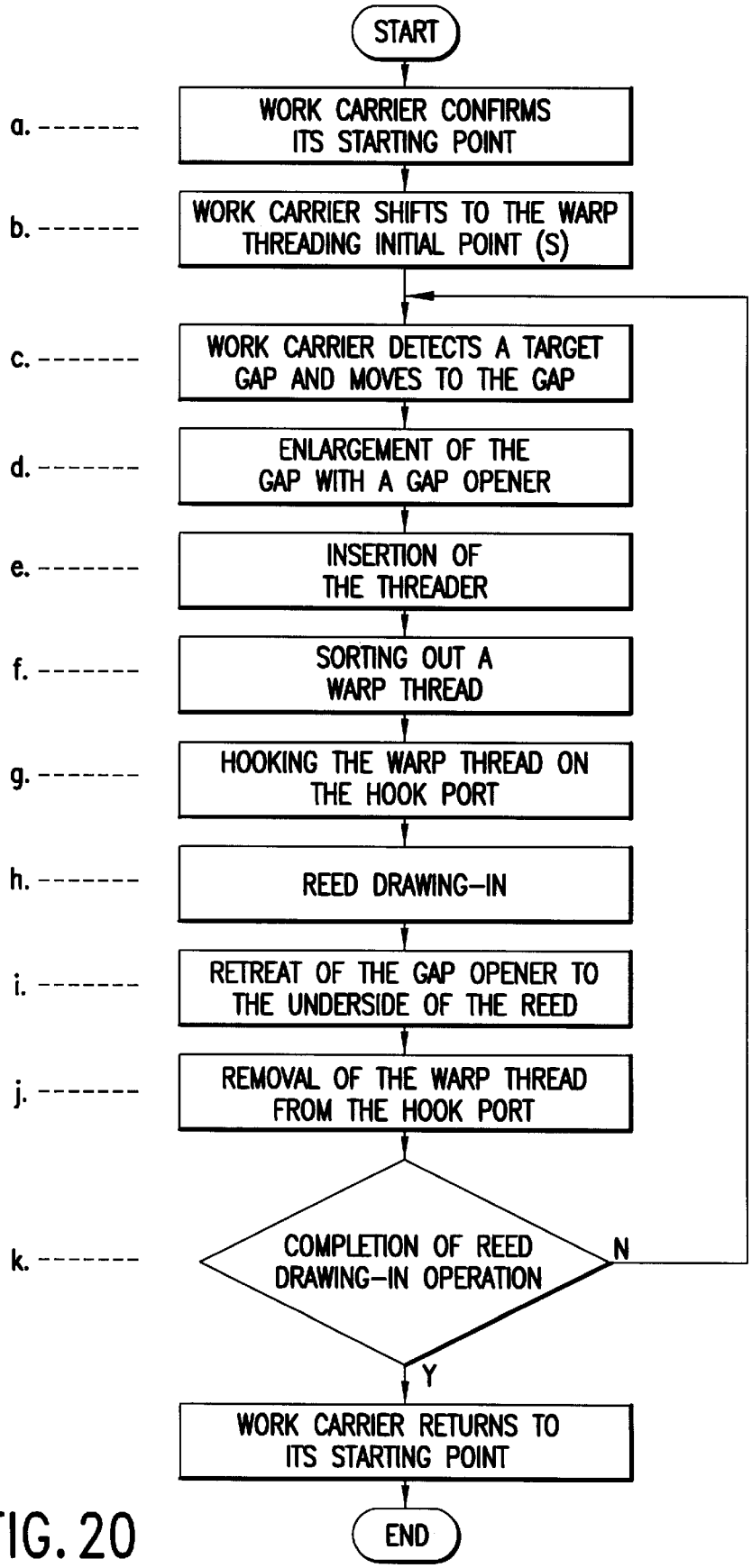
FIG. 20 is a flow chart showing the main steps of the reed drawing-in operation embodied in the present invention.
Figure 20:
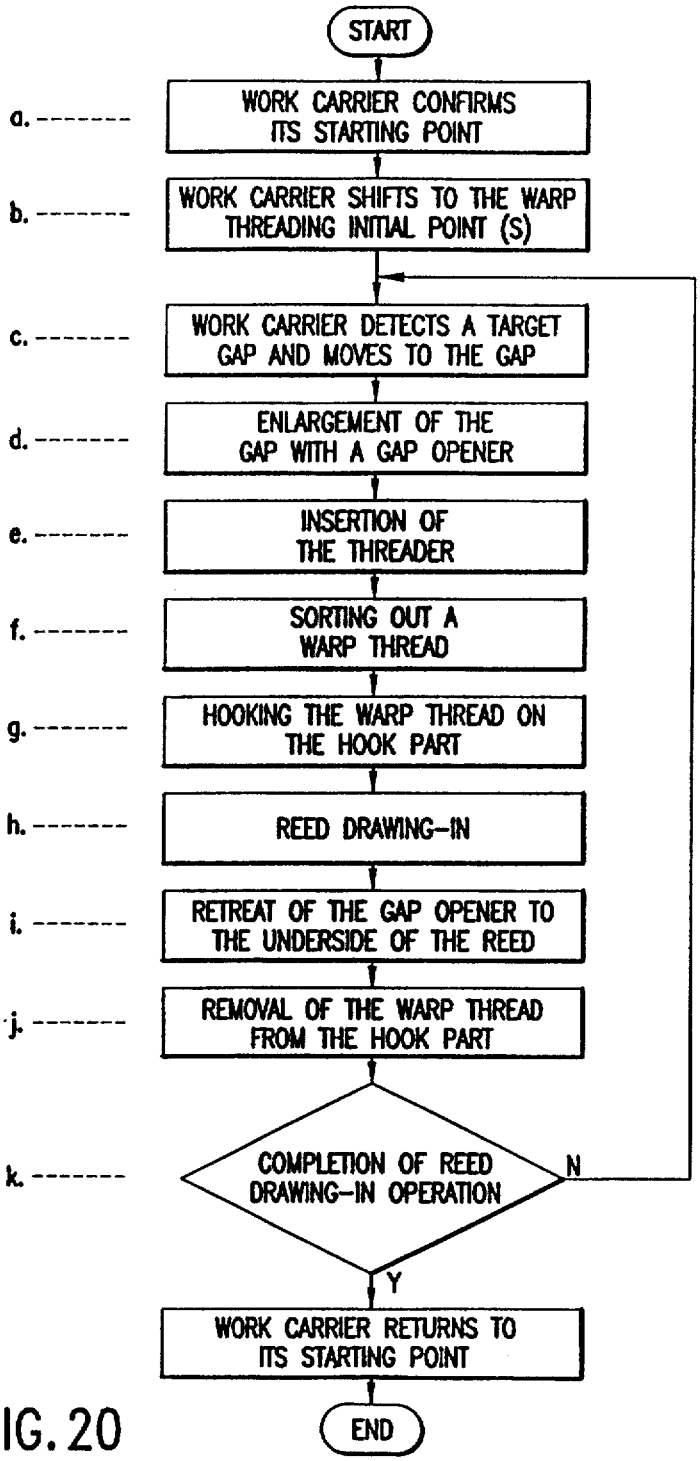

Then, the microcomputer (C) reads whether there is a gap left or not and if so, the same reed drawing-in operation as mentioned above is performed on an adjacent gap (see "N" route in step "k" of FIG. 20).

Otherwise or when the work carrier (WC) has shifted to the ultimate point (E) of the reed (R), all the reed drawing-in operations are over and the work carrier (WC) is retracted to the starting point (O) (see "Y" route in step "k" of FIG. 20). In this regard, whether there is any gap left is read in accordance with the change of waveforms of picture signals output by the CCD camera (refer to FIG. 13). In short, said waveforms vary in accordance with the change of the reed-dents density in the two marginal regions between the high-density area (RH) and the low-density areas (RL). Although reed drawing-in operation is performed on all the reed-dents in the high-density area (RH) in the present embodiment, it is also possible to perform said operation by preliminarily programming a given interval between one gap and the next gap in the microcomputer (C).

The embodiment of the present invention to be disclosed herein is substantially as described above. However, it should be understood that the present invention is not limited to said embodiment, but can be modified in various ways within the scope of the accompanying claims.

For example, two servomotors (22) and (24) are adopted as back-and-forth driving control mechanism for the sharp-pointed pin (21*a*) of the gap opener (21) and the threader (23) respectively in the present embodiment, but it is also possible to drive them with just one servomotor by causing time lag between the movement of the sharp-pointed pin (21*a*) and that of the hook part (2*f*) of the threader (23). It is also possible to adopt a driving mechanism by means of fluid pressure such as an air cylinder instead of those two servomotors.

The sharp-pointed or lanceolate pin (21*a*) which is thicker at the foot is adopted as a tip of the gap opener (21) in the present embodiment, but it is also possible to insert an oar-like slat into a gap of adjacent reed-dents and twist said slat in the gap so as to enlarge it.

It should be understood that the above-mentioned modifications are only a few examples of modified embodiments in accordance with the working of the present invention, and those modifications are obviously within the technical scope of the present invention.

We claim:

1. A method of drawing a warp thread into a gap between adjacent reed-dents in a high-density reed of a loom, comprising the steps of:

(a) locally irradiating a surface of the reed with an infrared search beam;

(b) converting a quantity of light of said search beam which varies according to whether there is a dent at the irradiated surface into photoelectricity using a CCD camera to obtain a picture signal output having a waveform;

(c) determining a peak location of the picture signal by smoothing said signal;

(d) calculating a distance to a target gap between adjacent dents on the basis of the peak locating using a microcomputer, the peak location corresponding to said target gap;

(e) inputting a calculated value of the distance to said target gap as a numerical movement command signal into a work carrier movable latitudinally of the reed so as to precisely shift said work carrier to a reed drawing-in position, said work carrier being provided with a gap opener having a sharp-pointed pin with a thicker under-part for enlarging said gap and with a threader for drawing a warp thread into the gap;

(f) gradually separating the dents disposed on opposite sides of the target gap by thrusting said pin into said gap so as to enlarge the target gap;

(g) thrusting the threader into the enlarged gap and hooking a warp thread from a thread supply section arranged opposite the reed, thereby, drawing said warp thread into the gap.

2. A reed drawing-in apparatus for a high-density reed of a loom, comprising a work carrier movable in the latitudinal direction of the reed to a reed drawing-in position under a numerical movement command signal, said work carrier carrying:

(a) an infrared beam source for locally irradiating a surface of the reed with an infrared beam;

(b) a CCD camera arranged to convert a quantity of light of said beam varying according to whether there is a dent at the irradiated surface into photoelectricity so as to obtain a picture signal output having a waveform;

(c) a microcomputer arranged to calculate distance to a target gap between adjacent dents on the basis of a peak location determined from a smoothed waveform derived from said picture signal output and to output said numerical movement command signal so as to precisely shift said work carrier to a reed drawing-in position;

(d) a gap opener having a sharp-pointed pin with a thicker underpart which is arranged to separate the dents on opposite sides of the target gap in such a manner that a tip of said gap opener is first thrust into said gap so as to gradually enlarge the gap when the carrier has reached the reed drawing-in position;

(e) a threader arranged to thrust into a gap enlarged by the sharp-pointed pin of said gap opener for hooking a warp thread from a thread supply section arranged opposite the reed and for drawing the warp thread into the gap.

3. A reed drawing-in apparatus as claimed in claim 2, wherein the sharp-pointed pin of the gap opener and the threader are aligned in the longitudinal direction of the gap between said adjacent dents.

* * * * *

UNITED STATES PATENT AND TRADEMARK OFFICE

CERTIFICATE OF CORRECTION

PATENT : 5,806,156

DATED : September 15, 1998

INVENTOR(S) : Kenji Hashizume et al

It is certified that error appears in the above-identified patent and that said Letters Patent is hereby corrected as shown below:

In the drawings Fig. 20, should be deleted to be replaced with the corrected Fig. 20, as shown on the attached page.

In column 7, line 38, "book" should read –hook–.

Signed and Sealed this

Ninth Day of February, 1999

*Attest:*

*Attesting Officer*

*Acting Commissioner of Patents and Trademarks*